US012704025B2

(12) United States Patent
Ren et al.

(10) Patent No.: US 12,704,025 B2
(45) Date of Patent: Aug. 11, 2026

(54) LONG-LIFE DRILL BIT WITH DOWNHOLE SELF-RENEWAL CAPABILITY

(71) Applicant: Southwest Petroleum University, Chengdu City (CN)

(72) Inventors: Haitao Ren, Chengdu City (CN); Aixuan Wu, Chengdu City (CN); Kuilin Huang, Chengdu City (CN); Jiangtao Zheng, Chengdu City (CN); Yixin Chen, Chengdu City (CN); Qi Zhan, Chengdu City (CN); Chunxiao Zhou, Chengdu City (CN)

(73) Assignee: Southwest Petroleum University, Chengdu City (CN)

( * ) Notice: Subject to any disclaimer, the term of this patent is extended or adjusted under 35 U.S.C. 154(b) by 0 days.

(21) Appl. No.: 19/078,972

(22) Filed: Mar. 13, 2025

(65) Prior Publication Data

US 2026/0002417 A1 Jan. 1, 2026

(30) Foreign Application Priority Data

Jul. 1, 2024 (CN) ..... 202410872472.X

(51) Int. Cl.
*E21B 10/54* (2006.01)

(52) U.S. Cl.
CPC ..... *E21B 10/54* (2013.01)

(58) Field of Classification Search
CPC ..... E21B 10/006; E21B 10/54; E21B 10/42
See application file for complete search history.

(56) References Cited

U.S. PATENT DOCUMENTS 1,439,092 A * 12/1922 Gibson, Jr. ..... E21B 10/32 175/286
3,024,855 A * 3/1962 Kellner ..... E21B 10/00 175/379
3,066,749 A * 12/1962 Hildebrandt ..... E21B 10/14 175/379
8,985,243 B2 * 3/2015 Yang ..... E21B 10/14 175/336
10,352,101 B2 * 7/2019 Yang ..... E21B 10/46

FOREIGN PATENT DOCUMENTS

CN 108086916 A 5/2018

OTHER PUBLICATIONS

Office action issued by the National Intellectual Property Administration of the People's Republic of China, dated Aug. 3, 2024, from CN 202410872472.X.

* cited by examiner

*Primary Examiner* — Catherine Loikith
(74) *Attorney, Agent, or Firm* — Thomas | Horstemeyer, LLP

(57) ABSTRACT

A long-life drill bit with a downhole self-renewal capability is provided. The long-life drill bit with a downhole self-renewal capability includes a drill bit body and a joint. A fixed blade and a support blade are arranged on the drill bit body. Main cutting teeth are embedded in the fixed blade. Central flow channels are arranged inside the drill bit body and the joint. A self-renewal wheel is arranged on the support blade, and the self-renewal wheel is rotatably connected with the support blade through a wheel shaft. A ratchet shaft, a transmission shaft, a spring, a sliding pin and the like are arranged inside the drill bit body, and the self-renewal wheel can realize a driving rotation action through transmission of the ratchet shaft. Self-renewal teeth are also arranged on the self-renewal wheel.

7 Claims, 7 Drawing Sheets

LONG-LIFE DRILL BIT WITH DOWNHOLE SELF-RENEWAL CAPABILITY

CROSS-REFERENCE TO RELATED APPLICATION

This patent application claims the benefit and priority of Chinese Patent Application No. 202410872472.X filed with the China National Intellectual Property Administration on Jul. 1, 2024, the disclosure of which is incorporated by reference herein in its entirety as part of the present application.

TECHNICAL FIELD

The present disclosure belongs to the field of technical equipment such as oil and gas drilling engineering, mine engineering, building foundation engineering construction, geological drilling, tunnel engineering hydrology and non-excavation technical equipment, and specifically relates to a long-life drill bit with a downhole self-renewal capability.

BACKGROUND

Polycrystalline diamond compact is a cutting element used on drilling tools and rock breaking tools in drilling engineering, which is referred to as compact teeth or PDC (Polycrystalline Diamond Compact) teeth for short. The conventional polycrystalline diamond compact is usually composed of a polycrystalline diamond layer and a matrix (the matrix is usually made of cemented carbide) at high temperature and high pressure. Therefore, the compact not only has high hardness, high wear resistance and thermal conductivity of the polycrystalline diamond layer, but also has the strength and impact toughness of cemented carbide.

Most of long-life PDC drill bits in the prior art are added with multiple rows of teeth (insert teeth and the like) on the basis of cutting teeth of the conventional PDC drill bits. When the exposed height of the first row of cutting teeth is completely worn out, the second row of cutting teeth is exposed one after another to participate in rock cutting. Obviously, when the exposed height of the first row of cutting teeth is zero, regardless of whether the new teeth are exposed or not, the blade body always participates in cutting together with the PDC teeth, thus greatly reducing the specific pressure of cutting teeth in local areas on the drill bit and weakening the rock biting capacity of the drill bit. Although the means for prolonging the life of the PDC drill bit in the prior art make the drill bit more durable to a certain extent, the drilling efficiency of the drill bit is seriously affected at the same time, and the effect of giving consideration to the life and efficiency is not realized.

In addition, in the design process of the PDC drill bit, a plane passing through the central axis of the bit is usually arbitrarily determined as a tooth distribution axial surface (also referred to as an axial surface for short), and the radial and axial positions of each cutting tooth on the drill bit can be accurately expressed on the axial surface. When the drill bit rotates around the own axis of the drill bit under the condition that the axial position remains unchanged, the tooth edge contour line of the cutting tooth intersects with the axial surface to form an intersection line. The intersection line is an axial surface contour line of the cutting tooth, and then the axial surface contour lines of all the main cutting teeth on the drill bit (or all the main cutting teeth on a plurality of designated blades) are collected in the axial surface to form an axial surface tooth distribution diagram of the drill bit (or an axial surface tooth distribution diagram of multiple designated blades). Because the axial surface tooth distribution diagram can accurately reflect the radial coverage of the cutting teeth on the drill bit to the bottom hole rock, the diagram is also called a bottom hole coverage tooth distribution diagram, referred to as a coverage tooth distribution diagram or a bottom hole coverage diagram for short. In the bottom hole coverage diagram of the drill bit, an outer envelope curve tangent to the axial surface contour line of all main cutting teeth, that is, a cutting contour line of the drill bit (that is, a crown contour line of the drill bit), is drawn. In addition, if only the cutting teeth on a certain designated blade are shown and the cutting teeth on other blade are hidden, the axial surface tooth distribution diagram of the blade is formed. In the axial surface tooth distribution diagram of the blade, an outer envelope curve tangent to the axial surface contour line of each main cutting tooth is drawn, and the envelope is called a cutting contour line of the blade. If the drill bit rotates around the own axis of the drill bit under the condition that the axial position remains unchanged, for a certain blade body, the intersection line between the front side of the blade body and the tooth distribution surface is swept with the rotation of the drill bit to form a rotating curved surface with the central axis of the drill bit as the axis. The intersection line between the rotating curved surface and the axial surface is a body contour line of the blade, that is, a blade contour line. Usually, because the exposed heights of the main cutting teeth arranged on the tooth distribution surface of the blade are the same or similar (except the area adjacent to a gage diameter surface), the cutting contour line of the blade and the shape of the body contour line of the blade are basically parallel. There may be obvious differences only in the area adjacent to the gage diameter. Therefore, usually, if the cutting contour lines of different blades need to be matched and suitable with each other, the contour lines of different blades need to be designed in completely or basically same shapes, and then the exposed height is in a same or similar tooth distribution manner.

The Chinese patent "long-life PDC drill bit with transposition blade" (with the patent number of CN108086916A) discloses a long-life PDC drill bit with a transposition blade. The transposition blade can be remotely controlled relative to a support body of the transposition blade to rotate to a certain preset working position through at least one time of rotation from an initial working position and to be locked, or to rotate to another preset working position through at least one time of rotation from a certain preset working position and to be locked. After the initial cutting teeth are worn, the new cutting teeth can be remotely controlled on the ground to replace the worn cutting teeth and continue drilling, so that the drill bit can update the cutting structure downhole once or even repeatedly, and the effect of "updating the drill bit without drilling" is realized. The patented technology realizes the rotation of the blade through remote control (in a ball throwing manner) to realize the bottom hole update of the cutting structure of the drill bit. After the blade rotates, a special limit and locking mechanism is needed, so that the drill bit update is complex in operation, low in degree of intellectualization and automation, and human experience is needed to judge the operation. In order to overcome the defects, a long-life drill bit with a downhole self-renewal capability is proposed.

SUMMARY

Some embodiments aim to provide a long-life drill bit with a downhole self-renewal capability. The rotation of a ratchet is realized by means of liquid pressure and mechanical transmission, so that the rotation of a self-renewal wheel is realized. Self-renewal teeth are overturned to an outer surface of the blade to form a part of a drill bit cutting structure, so that the long-life drill bit has a downhole self-renewal capability and achieves the purpose of prolonging the service life.

To achieve the above purpose, the present disclosure adopts the following technology.

A long-life drill bit with a downhole self-renewal capability includes a drill bit body and a joint, a fixed blade and a support blade are arranged on the drill bit body, main cutting teeth are embedded in the fixed blade, and central flow channels are arranged inside the drill bit body and the joint, a self-renewal wheel is arranged on the support blade, the self-renewal wheel is provided with self-renewal teeth, the self-renewal wheel is rotatably connected with the support blade through a wheel shaft, and one end of the self-renewal wheel is provided with a first cone wheel; and a transmission shaft, a ratchet shaft, a spring and a sliding pin are arranged inside the drill bit body, a second cone wheel is arranged at one end of the transmission shaft and a spline groove is arranged at an other end of the transmission shaft, the second cone wheel of the transmission shaft and the first cone wheel of the self-renewal wheel are meshed with each other, an upper spline is arranged at one end of the ratchet shaft, a ratchet groove is formed in the ratchet shaft, a lower end of the ratchet shaft is provided with a pressure-bearing surface, the upper spline of the ratchet shaft and the spline groove of the transmission shaft are matched with each other, the sliding pin and the ratchet groove are in a sliding fit, the spring is arranged between the ratchet shaft and the transmission shaft, and the sliding pin is arranged between the drill bit body and the joint.

In the scheme, a long-life drill bit with a downhole self-renewal capability includes a drill bit body and a joint, a fixed blade and a support blade are arranged on the drill bit body, main cutting teeth are embedded in the fixed blade, and central flow channels are arranged inside the drill bit body and the joint, a self-renewal wheel is arranged on the support blade, the self-renewal wheel is provided with self-renewal teeth, the self-renewal wheel is rotatably connected with the support blade through a wheel shaft, and one end of the self-renewal wheel is provided with a first cone wheel; and a transmission shaft, a ratchet shaft, a spring and a sliding pin are arranged inside the drill bit body, a second cone wheel is arranged at one end of the transmission shaft and a spline groove is arranged at an other end of the transmission shaft, the second cone wheel of the transmission shaft and the first cone wheel of the self-renewal wheel are meshed with each other, an upper spline is arranged at one end of the ratchet shaft, a ratchet groove is formed in the ratchet shaft, a lower end of the ratchet shaft is provided with a pressure-bearing surface, the upper spline of the ratchet shaft and the spline groove of the transmission shaft are matched with each other, the sliding pin and the ratchet groove are in a sliding fit, the spring is arranged between the ratchet shaft and the transmission shaft, and the sliding pin is arranged between the drill bit body and the joint. When the self-renewal teeth on the self-renewal wheel are worn, the rate of penetration of the drill bit is reduced. At this time, the drill bit is lifted to get away from the bottom, so that the drill bit does not bear load, and the discharge capacity of a drilling fluid needs to be increased. Referring to FIG. 9 to FIG. 13, the drilling fluid acts on the pressure-bearing surface of the ratchet shaft. At this time, the sliding pin is at a top dead center, as shown in FIG. 9. The drilling fluid pushes the whole ratchet wheel to move upward and compresses the spring. At this time, the sliding pin is in sliding fit with the ratchet groove in the ratchet shaft, and the sliding pin makes contact with a lower bevel of the ratchet groove, as shown in FIG. 10. With the existence of the bevel on the ratchet groove, the bevel can push the ratchet shaft to continue to rotate until the sliding pin is at a bottom dead center of the ratchet groove, as shown in FIG. 11. At this time, the discharge capacity of the drilling fluid is reduced. Under the action of the spring, the ratchet shaft moves downward, and the sliding pin gradually reaches an upper bevel of the ratchet groove, as shown in FIG. 12. Under the action of the bevel, the ratchet shaft is pushed to continue to rotate until the ratchet shaft is at a top dead center of the ratchet groove, as shown in FIG. 13. Thus, the ratchet shaft rotates while moving. An upper end of the ratchet shaft is provided with an upper spline, a transmission shaft is provided with a spline groove. The upper spline and the spline groove are matched with each other. Thus, the ratchet can drive the transmission shaft to rotate. The second cone wheel at the upper end of the transmission shaft and the first cone wheel on the self-renewal wheel are meshed with each other to drive the rotation of the self-renewal wheel. The self-renewal teeth are overturned to an outer surface of the blade to form a part of a drill bit cutting structure, so that the drill bit has a downhole self-renewal capability, and achieves the purpose of prolonging the service life. The first and second cone wheels are meshed with each other to realize self-locking. The ratchet groove in the ratchet shaft can move in one direction only, and double self-locking can be realized, so that the downhole safety of the self-renewal wheel is greatly improved.

Alternatively, the support blade includes at least one group of support blades, the at least one group of support blades are arranged on the drill bit body, two ends of the wheel shaft of the self-renewal wheel are both supported so as to be respectively in rotational connection with the support blade.

In the scheme, the support blade includes at least one group of support blades, the at least one group of support blades are arranged on the drill bit body, two ends of the wheel shaft of the self-renewal wheel are both supported so as to be respectively in rotational connection with the support blade. By bilateral bracing rotational connection, the stress condition of the wheel shaft can be obviously improved, and the diameter of the wheel shaft can be reduced, so that the bearing capacity of the wheel shaft can be improved. Even if the self-renewal wheel is shaken in a seal failure, the self-renewal wheel cannot fall to the bottom.

Alternatively, the sliding pin is arranged between the drill bit body and the joint, the sliding pin is installed and fixed by an assembly unit composed of a bearing and an installation sleeve.

In the scheme, the sliding pin is arranged between the drill bit body and the joint, the sliding pin is installed and fixed by an assembly unit composed of a bearing and an installation sleeve. At this time, the sliding pin can self-rotate, so that the friction coefficient is reduced and the movement efficiency of the ratchet shaft is improved by means of rolling instead of sliding when the sliding pin makes contact with the ratchet groove.

Alternatively, at least two groups of the self-renewal teeth are arranged on the self-renewal wheel, each of the at least two groups of the self-renewal teeth is arranged along an axial direction of the wheel shaft of the self-renewal wheel.

In the scheme, at least two groups of the self-renewal teeth are arranged on the self-renewal wheel, each of the at least two groups of the self-renewal teeth is arranged along an axial direction of the wheel shaft of the self-renewal wheel. The self-renewal wheel is provided with at least two groups of cutting teeth, indicating that the self-renewal wheel can be renewed at least once, so that the more the groups of cutting teeth on the self-renewal wheel, the more times the self-renewal wheel is renewed, and the service life of the drill bit is greatly improved.

Alternatively, the self-renewal wheel and the wheel shaft are of an integrated structure.

In the scheme, the self-renewal wheel and the wheel shaft are of an integrated structure, so that the shell thickness of the self-renewal wheel is greatly increased, and the downhole accident caused by a rotating body falling off and falling into the bottom of the existing drill bit due to cracking or damage of the shell can be effectively reduced.

Alternatively, the self-renewal wheel and the wheel shaft are of a split structure, the self-renewal wheel is rotationally fitted with the wheel shaft.

In the scheme, the self-renewal wheel and the wheel shaft are of a split structure, and the self-renewal wheel is rotationally fitted with the wheel shaft. On one hand, the wheel shaft and the support blade are fixedly connected, so that the structural strength is further enhanced. On the other hand, the rotation of the self-renewal wheel is more flexible. The self-renewal wheel is in connection with the wheel shaft through a key, a spline or interference fit. The wheel shaft is rotatably connected with the support blade, and the rotational size of the wheel shaft and the support blade is adjustable, so that the bearing capacity of the wheel shaft is greatly increased, and the service life of the wheel shaft system is prolonged.

Alternatively, axe-shaped teeth, Benz teeth and cone-shaped PDC teeth are arranged on the self-renewal wheel.

In the scheme, axe-shaped teeth, Benz teeth and cone-shaped PDC teeth are arranged on the self-renewal wheel. The cutting teeth of different shapes are matched with different layers, so that the range of application of the drill bit is widened.

Firstly, the self-renewal teeth are overturned to an outer surface of the blade to form a part of a drill bit cutting structure, so that the long-life drill bit has a downhole self-renewal capability and achieves the purpose of prolonging the service life. The first and second cone wheels are meshed with each other to realize self-locking. The ratchet groove in the ratchet shaft can move in one direction only, and double self-locking can be realized, so that the downhole safety of the self-renewal wheel is greatly improved.

Secondly, two ends of the wheel shaft of the renewal wheel are both supported so as to be respectively in rotational connection with the support blades. By the bilateral bracing rotational connection, the stress condition of the wheel shaft can be obviously improved, and the diameter of the wheel shaft can be reduced, so that the bearing capacity of the wheel shaft can be improved. Even if the self-renewal wheel is shaken in a seal failure, the self-renewal wheel cannot fall to the bottom.

Thirdly, the sliding pin is arranged between the drill bit body and the joint. The sliding pin is installed and fixed by an assembly unit composed of a bearing and an installation sleeve. At this time, the sliding pin can self-rotate, so that the friction coefficient is reduced and the movement efficiency of the ratchet shaft is improved by means of rolling instead of sliding when the sliding pin makes contact with the ratchet groove.

Fourthly, self-renewal wheel and the wheel shaft are of an integrated structure, so that the shell thickness of the self-renewal wheel is greatly increased, and the downhole accident caused by a rotating body falling off and falling into the bottom of the existing drill bit due to cracking or damage of the shell can be effectively reduced.

Fifthly, axe-shaped teeth, Benz teeth and cone-shaped PDC teeth are arranged on the self-renewal wheel. The cutting teeth of different shapes are matched with different layers, so that the range of application of the drill bit is widened.

REFERENCE SIGNS

1 drill bit body; 11 fixed blade; 12 support blade; 2 joint; 3 central flow channel; 4 main cutting tooth; 5 self-renewal wheel; 51 self-renewal tooth; 511 cone-shaped PDC tooth; 512 axe-shaped tooth; 513 Benz tooth; 52 wheel shaft; 521 key slot; 6 ratchet shaft; 61 ratchet groove; 62 pressure-bearing surface; 63 upper spline; 64 main flow channel; 7 transmission shaft; 71 spline groove; 8 sliding pin; 81 bearing; 82 installation sleeve; 9 spring; 10 first cone wheel; and 72 second cone wheel.

DETAILED DESCRIPTION OF THE EMBODIMENTS

The following non-restrictive embodiments are used for describing the present disclosure.

Figure 9:
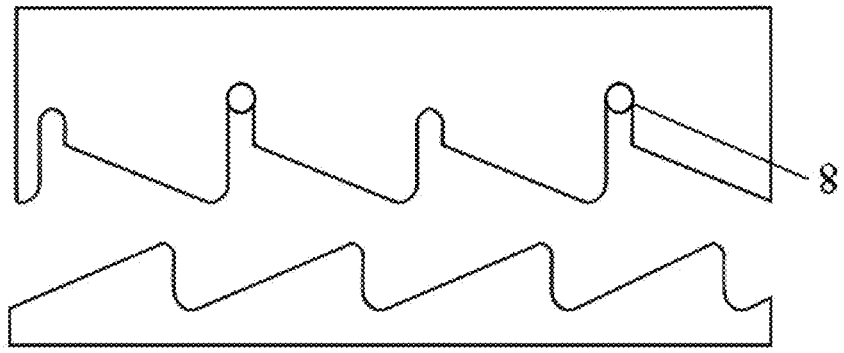
FIG. 9 is a schematic diagram of a sliding pin located at a top dead center of a ratchet groove.
Figure 10:
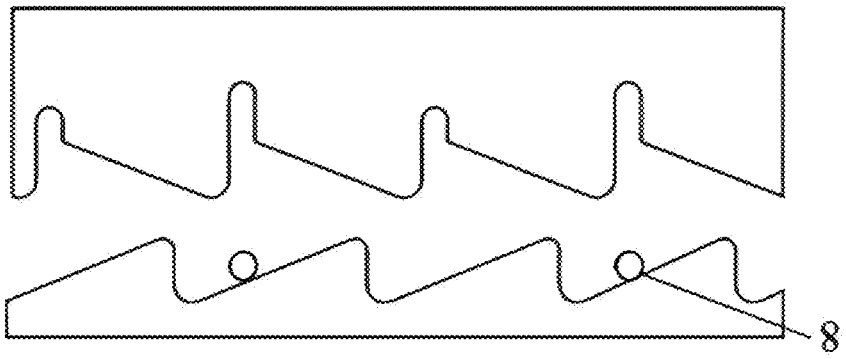
FIG. 10 is a schematic diagram of a sliding pin located on a lower bevel of a ratchet groove.
Figure 11:
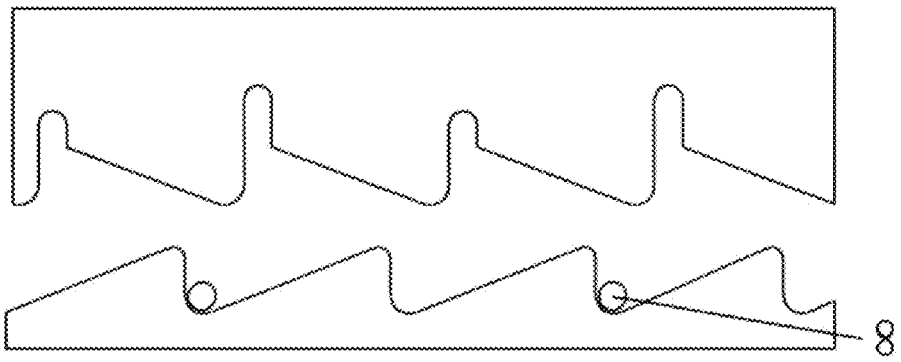
FIG. 11 is a schematic diagram of a sliding pin located at a bottom dead center of a ratchet groove.
Figure 12:
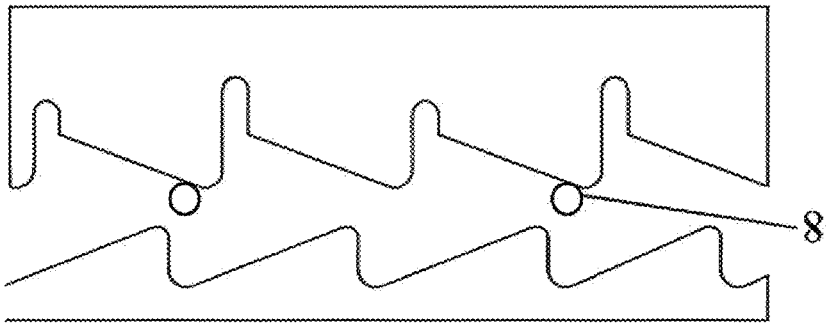
FIG. 12 is a schematic diagram of a sliding pin located on an upper bevel of a ratchet groove.
Figure 13:
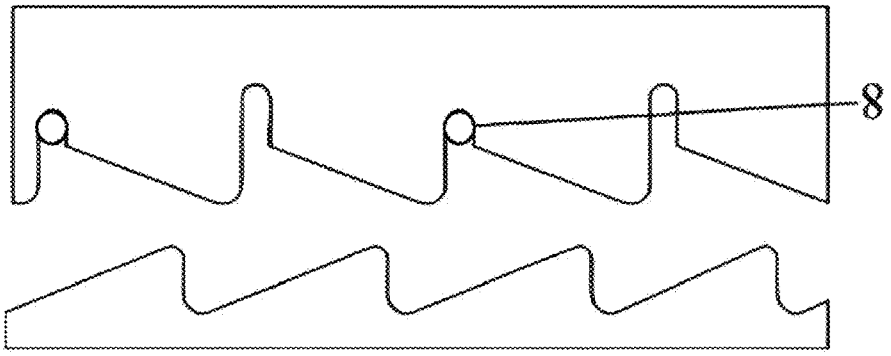
FIG. 13 is a schematic diagram of a sliding pin returning to a top dead center of a ratchet groove.

A long-life drill bit with a downhole self-renewal capability includes a drill bit body and a joint, a fixed blade and a support blade are arranged on the drill bit body, main cutting teeth are embedded in the fixed blade, and central flow channels are arranged inside the drill bit body and the joint, a self-renewal wheel is arranged on the support blade, the self-renewal wheel is provided with self-renewal teeth, the self-renewal wheel is rotatably connected with the support blade through a wheel shaft, and one end of the self-renewal wheel is provided with a first cone wheel; and a transmission shaft, a ratchet shaft, a spring and a sliding pin are arranged inside the drill bit body, a second cone wheel is arranged at one end of the transmission shaft and a spline groove is arranged at an other end of the transmission shaft, the second cone wheel of the transmission shaft and the first cone wheel of the self-renewal wheel are meshed with each other, an upper spline is arranged at one end of the ratchet shaft, a ratchet groove is formed in the ratchet shaft, a lower end of the ratchet shaft is provided with a pressure-bearing surface, the upper spline of the ratchet shaft and the spline groove of the transmission shaft are matched with each other, the sliding pin and the ratchet groove are in a sliding fit, the spring is arranged between the ratchet shaft and the transmission shaft, and the sliding pin is arranged between the drill bit body and the joint. When the self-renewal teeth on the self-renewal wheel are worn, the rate of penetration of the drill bit is reduced. At this time, the drill bit is lifted to get away from the bottom, so that the drill bit does not bear load, and the discharge capacity of a drilling fluid needs to be increased. Referring to FIG. 9 to FIG. 13, the drilling fluid acts on the pressure-bearing surface of the ratchet shaft. At this time, the sliding pin is at a top dead center, as shown in FIG. 9. The drilling fluid pushes the whole ratchet wheel to move upward and compresses the spring. At this time, the sliding pin is in sliding fit with the ratchet groove in the ratchet shaft, and the sliding pin makes contact with a lower bevel of the ratchet groove, as shown in FIG. 10. With the existence of the bevel on the ratchet groove, the bevel can push the ratchet shaft to continue to rotate until the sliding pin is at a bottom dead center of the ratchet groove, as shown in FIG. 11. At this time, the discharge capacity of the drilling fluid is reduced. Under the action of the spring, the ratchet shaft moves downward, and the sliding pin gradually reaches an upper bevel of the ratchet groove, as shown in FIG. 12. Under the action of the bevel, the ratchet shaft is pushed to continue to rotate until the ratchet shaft is at a top dead center of the ratchet groove, as shown in FIG. 13. Thus, the ratchet shaft rotates while moving. An upper end of the ratchet shaft is provided with an upper spline, a transmission shaft is provided with a spline groove. The upper spline and the spline groove are matched with each other. Thus, the ratchet can drive the transmission shaft to rotate. The second cone wheel at the upper end of the transmission shaft and the first cone wheel on the self-renewal wheel are meshed with each other to drive the rotation of the self-renewal wheel. The self-renewal teeth are overturned to an outer surface of the blade to form a part of a drill bit cutting structure, so that the drill bit has a downhole self-renewal capability, and achieves the purpose of prolonging the service life. The first and second cone wheels are meshed with each other to realize self-locking. The ratchet groove in the ratchet shaft can move in one direction only, and double self-locking can be realized, so that the downhole safety of the self-renewal wheel is greatly improved, as shown in FIG. 1, FIG. 2, FIG. 3, FIG. 4, FIG. 5, FIG. 6 and FIG. 7.

Figure 1:
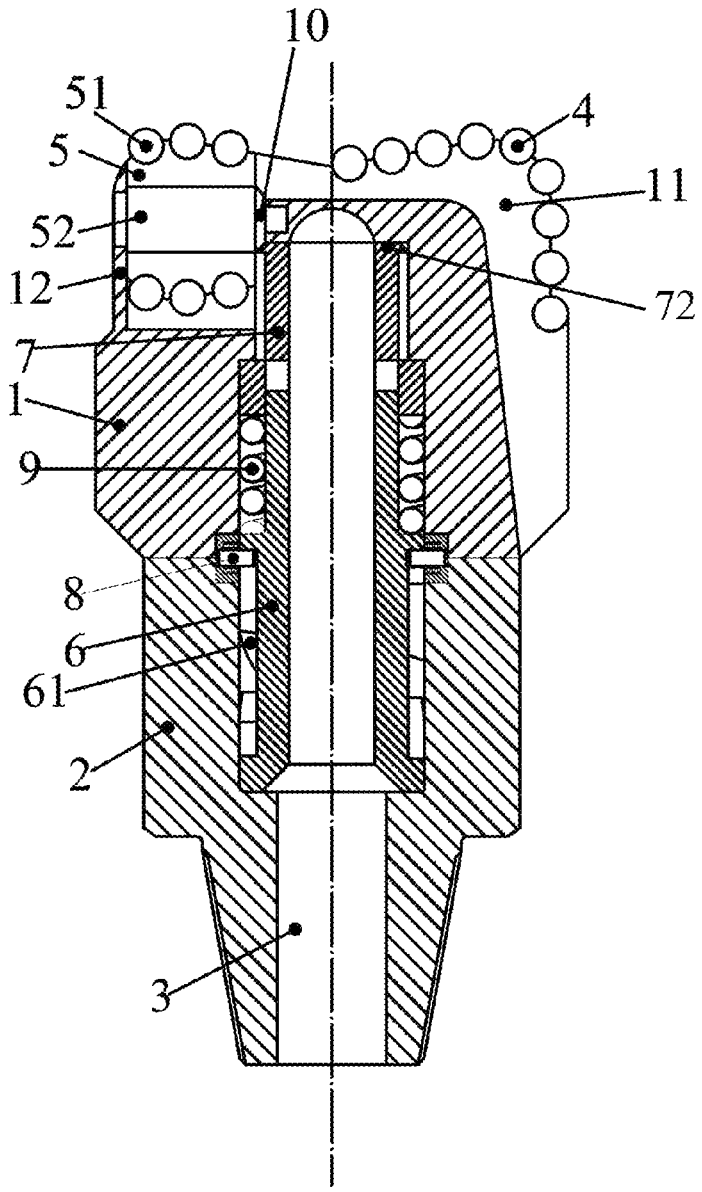
FIG. 1 is a section view of a long-life drill bit with a self-renewal capability in the present disclosure.

Preferably, the support blade includes at least one group of support blades, the at least one group of support blades are arranged on the drill bit body, two ends of the wheel shaft of the self-renewal wheel are both supported so as to be respectively in rotational connection with the support blade. By bilateral bracing rotational connection, the stress condition of the wheel shaft can be obviously improved, and the diameter of the wheel shaft can be reduced, so that the bearing capacity of the wheel shaft can be improved. Even if the self-renewal wheel is shaken in a seal failure, the self-renewal wheel cannot fall to the bottom, as shown in FIG. 1 and FIG. 6.

Figure 8:
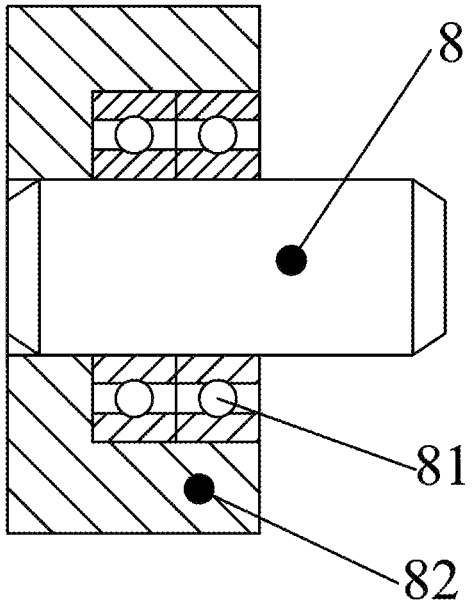
FIG. 8 is an installation diagram of a sliding pin.

Preferably, the sliding pin is arranged between the drill bit body and the joint, the sliding pin is installed and fixed by an assembly unit composed of a bearing and an installation sleeve. At this time, the sliding pin can self-rotate, so that the friction coefficient is reduced and the movement efficiency of the ratchet shaft is improved by means of rolling instead of sliding when the sliding pin makes contact with the ratchet groove, as shown in FIG. 8.

Figure 2:
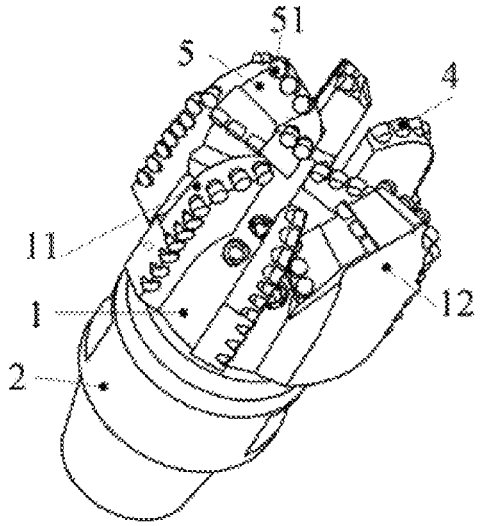
FIG. 2 is a solid diagram of a long-life drill bit with a self-renewal capability in the present disclosure.
Figure 3:
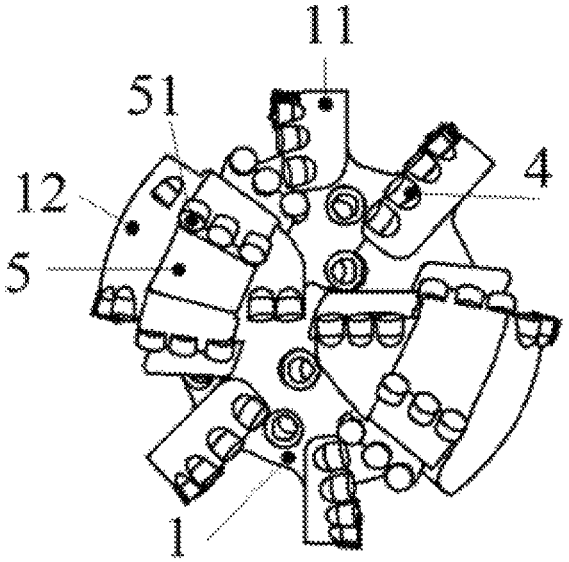
FIG. 3 is a top view of a long-life drill bit with a self-renewal capacity in the present disclosure.
Figure 4:
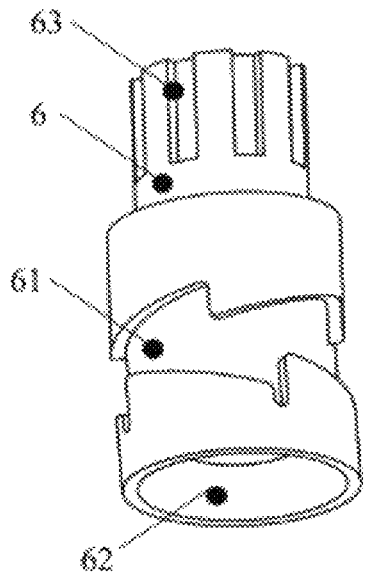
FIG. 4 is a solid diagram of a ratchet shaft.
Figure 5:
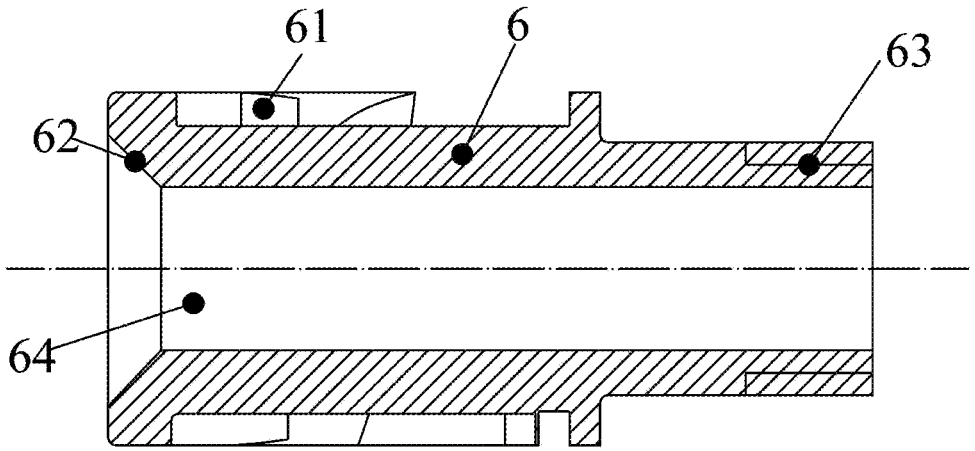
FIG. 5 is a section view of a ratchet shaft.

Preferably, at least two groups of the self-renewal teeth are arranged on the self-renewal wheel, each of the at least two groups of the self-renewal teeth is arranged along an axial direction of the wheel shaft of the self-renewal wheel. The self-renewal wheel is provided with at least two groups of cutting teeth, indicating that the self-renewal wheel can be renewed at least once, so that the more the groups of cutting teeth on the self-renewal wheel, the more times the self-renewal wheel is renewed, and the service life of the drill bit is greatly improved, as shown in FIG. 2 and FIG. 3.

Figure 6:
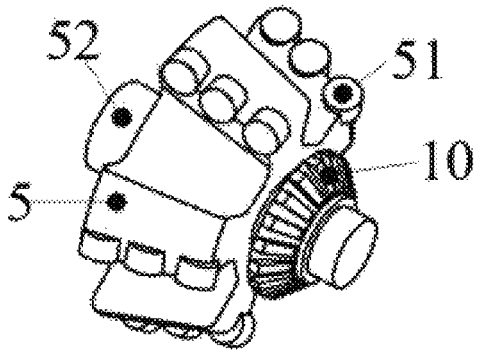
FIG. 6 is a solid diagram of a self-renewal wheel.
Figure 7:
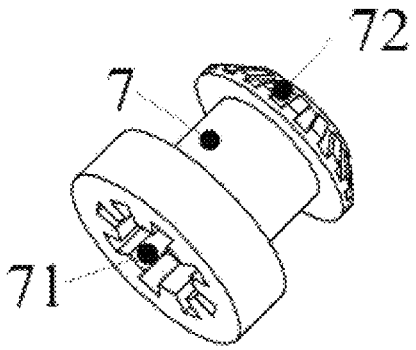
FIG. 7 is a solid diagram of a transmission shaft.

Preferably, the self-renewal wheel and the wheel shaft are of an integrated structure, so that the shell thickness of the self-renewal wheel is greatly increased, and the downhole accident caused by a rotating body falling off and falling into the bottom of the existing drill bit due to cracking or damage of the shell can be effectively reduced, as shown in FIG. 6.

Figure 14:
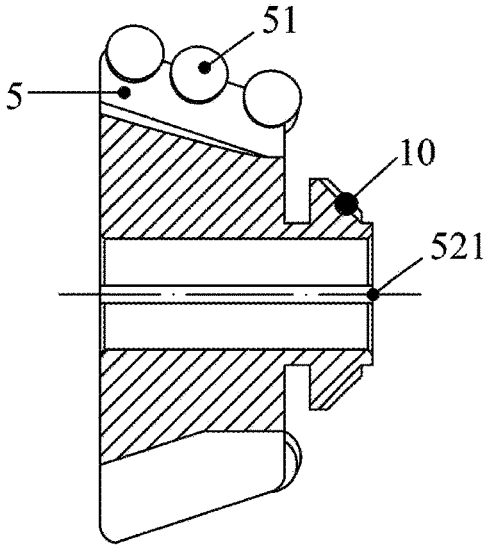
FIG. 14 is a schematic diagram of a split type self-renewal wheel.

Preferably, the self-renewal wheel and the wheel shaft are of a split structure, and the self-renewal wheel is rotationally fitted with the wheel shaft. On one hand, the wheel shaft and the support blade are fixedly connected, so that the structural strength is further enhanced. On the other hand, the rotation of the self-renewal wheel is more flexible. The self-renewal wheel is in connection with the wheel shaft through a key, a spline or interference fit. The wheel shaft is rotatably connected with the support blade, and the rotational size of the wheel shaft and the support blade is adjustable, so that the bearing capacity of the wheel shaft is greatly increased, and the service life of the wheel shaft system is prolonged, as shown in FIG. 14.

Figure 15:
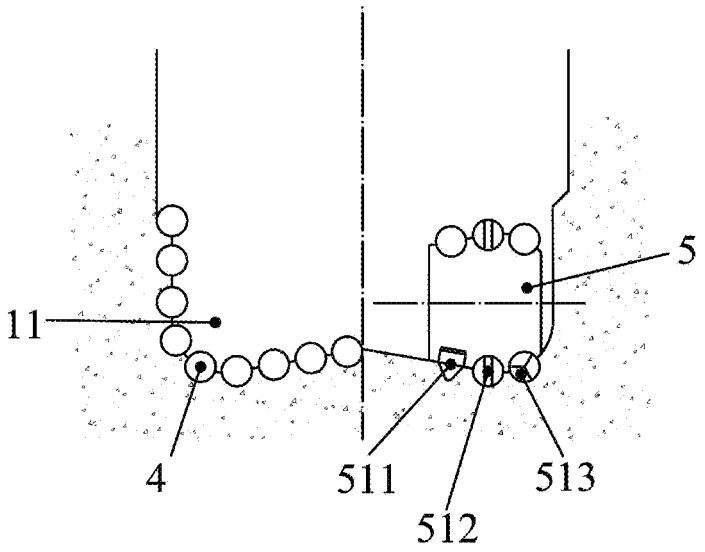
FIG. 15 is a schematic diagram of irregularly-shaped teeth.

Preferably, axe-shaped teeth, Benz teeth and cone-shaped PDC teeth are arranged on the self-renewal wheel. The cutting teeth of different shapes are matched with different layers, so that the range of application of the drill bit is widened, as shown in FIG. 15.

In sum, no limitation is made on the present disclosure in any form, although the better embodiment of the present disclosure is disclosed above, the better embodiment of the present disclosure is not used for limiting the present disclosure and any technician familiar with the specialty without departing from the scope of the technical solutions of the present disclosure; and when the technical content disclosed by the present disclosure is utilized to make some changes or modifications into equivalent embodiments with equivalent changes, but no matter how far away from the technical solutions content of the present disclosure, any simple modification, equivalent changes and modifications made on the embodiments according to the technology of the present disclosure belong to the scope of the technical solutions of the present disclosure.

What is claimed is:

1. A long-life drill bit with a downhole self-renewal capability, comprising:

a drill bit body and a joint, wherein a fixed blade and a support blade are arranged on the drill bit body, main cutting teeth are embedded in the fixed blade, and central flow channels are arranged inside the drill bit body and the joint, wherein a self-renewal wheel is arranged on the support blade, the self-renewal wheel is provided with self-renewal teeth, the self-renewal wheel is rotatably connected with the support blade through a wheel shaft, and one end of the self-renewal wheel is provided with a first cone wheel; and wherein a transmission shaft, a ratchet shaft, a spring and a sliding pin are arranged inside the drill bit body, a second cone wheel is arranged at one end of the transmission shaft and a spline groove is arranged at an other end of the transmission shaft, the second cone wheel of the transmission shaft and the first cone wheel of the self-renewal wheel are meshed with each other, an upper spline is arranged at one end of the ratchet shaft, a ratchet groove is formed in the ratchet shaft, a lower end of the ratchet shaft is provided with a pressure-bearing surface, the upper spline of the ratchet shaft and the spline groove of the transmission shaft are matched with each other, the sliding pin and the ratchet groove are in a sliding fit, the spring is arranged between the ratchet shaft and the transmission shaft, and the sliding pin is arranged between the drill bit body and the joint.

2. The long-life drill bit with the downhole self-renewal capability according to claim 1, the support blade comprises at least one group of support blades, wherein the at least one group of support blades are arranged on the drill bit body, two ends of the wheel shaft of the self-renewal wheel are both supported so as to be respectively in rotational connection with the support blade.

3. The long-life drill bit with the downhole self-renewal capability according to claim 1, wherein the sliding pin is arranged between the drill bit body and the joint, the sliding pin is installed and fixed by an assembly unit composed of a bearing and an installation sleeve.

4. The long-life drill bit with the downhole self-renewal capability according to claim 1, wherein at least two groups of the self-renewal teeth are arranged on the self-renewal wheel, each of the at least two groups of the self-renewal teeth is arranged along an axial direction of the wheel shaft of the self-renewal wheel.

5. The long-life drill bit with the downhole self-renewal capability according to claim 1, wherein the self-renewal wheel and the wheel shaft are of an integrated structure.

6. The long-life drill bit with the downhole self-renewal capability according to claim 1, wherein the self-renewal wheel and the wheel shaft are of a split structure, the self-renewal wheel is rotationally fitted with the wheel shaft.

7. The long-life drill bit with the downhole self-renewal capability according to claim 1, wherein axe-shaped teeth, Benz teeth and cone-shaped PDC (Polycrystalline Diamond Compact) teeth are arranged on the self-renewal wheel.

* * * * *